US011434181B2

(12) United States Patent
Seidner et al.

(10) Patent No.: US 11,434,181 B2
(45) Date of Patent: Sep. 6, 2022

(54) PRECURSOR FORMULATIONS FOR A PROPELLANT COMPOSITION INCLUDING HIGH SURFACE AREA AMORPHOUS CARBON BLACK

(71) Applicant: Northrop Grumman Systems Corporation, Falls Church, VA (US)

(72) Inventors: Nathan M. Seidner, North Ogden, UT (US); Jay D. Shuler, Willard, UT (US); Richard Brad Cragun, Pleasant View, UT (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 1470 days.

(21) Appl. No.: 13/832,960

(22) Filed: Mar. 15, 2013

(65) Prior Publication Data

US 2014/0260185 A1 Sep. 18, 2014

(51) Int. Cl.

| | |
|---|---|
| ***C06B 45/00*** | (2006.01) |
| ***C06B 23/00*** | (2006.01) |
| ***C06B 45/10*** | (2006.01) |

(52) U.S. Cl.

CPC ..... *C06B 45/00* (2013.01); *C06B 23/009* (2013.01); *C06B 45/10* (2013.01)

(58) Field of Classification Search

None

See application file for complete search history.

(56) References Cited

U.S. PATENT DOCUMENTS

| | | | | |
|---|---|---|---|---|
| 3,765,334 | A | 10/1973 | Clark et al. | |
| 3,924,405 | A * | 12/1975 | Cohen | C06B 23/04 149/110 |
| 4,072,546 | A | 2/1978 | Winer | |
| 4,663,230 | A | 5/1987 | Tennent et al. | |
| 4,696,705 | A | 9/1987 | Hamilton | |
| 5,098,771 | A | 3/1992 | Friend et al. | |
| 5,165,909 | A | 11/1992 | Tennent et al. | |
| 5,171,560 | A | 12/1992 | Tennent et al. | |
| 5,547,525 | A | 8/1996 | Bennett | |
| 6,228,192 | B1 * | 5/2001 | Neidert | C06B 25/18 149/100 |
| 6,982,013 | B1 | 1/2006 | Fallis et al. | |

(Continued)

OTHER PUBLICATIONS

Black Pearls 2000 carbon black, Cabot Product Data Sheet, cabotcorp.com (Sep. 2014) 2 pages.

(Continued)

*Primary Examiner* — Aileen B Felton

(74) *Attorney, Agent, or Firm* — TraskBritt

(57) ABSTRACT

A precursor formulation of an energetic composition with improved electrostatic charge dissipation, including an amorphous carbon black having a specific surface area of at least about 1,200 $m^2/g$, in an amount from about 0.05% by weight to about 0.25% by weight. Also disclosed is a precursor formulation of a propellant composition with improved electrostatic charge dissipation. The amorphous carbon black having a specific surface area of at least about 1,200 $m^2/g$ may enhance electrostatic charge dissipation of the HTPB-based propellant composition, without affecting a breakdown voltage of the propellant composition.

1 Claim, 3 Drawing Sheets

(56) References Cited

U.S. PATENT DOCUMENTS

| | | | | |
|---|---|---|---|---|
| 2003/0041935 | A1* | 3/2003 | Boyd | C06B 23/007 149/19.4 |
| 2004/0226638 | A1* | 11/2004 | Posson | C06B 21/0025 149/45 |
| 2005/0189053 | A1* | 9/2005 | Pile | C06C 7/00 149/108.6 |

OTHER PUBLICATIONS

Wikipedia, definition of Amorphous Carbon, website: https://en.wikipedia.org/wiki/Amorphous_carbon, accessed Jun. 23, 2017, 3 pages.

Wikipedia, definition of Carbon, website: https://en.wikipedia.org/wiki/Carbon, accessed Jun. 22, 2017, 21 pages.

* cited by examiner

PRECURSOR FORMULATIONS FOR A PROPELLANT COMPOSITION INCLUDING HIGH SURFACE AREA AMORPHOUS CARBON BLACK

TECHNICAL FIELD

The present disclosure relates generally to precursor formulations suitable for use as an energetic material. More specifically, the present disclosure relates to precursor formulations for use as an energetic material that includes high surface area carbon black, wherein the energetic material reduces the likelihood of premature ignition or explosion due to electrostatic charge buildup during manufacture, transportation, storage, or use.

BACKGROUND

The sensitivity to electrostatic discharge of energetic compositions, including solid propellant, gas generant, and pyrotechnic compositions, is well known. Numerous sources of electrical discharge have been cited as possible causes of catastrophic explosion or premature ignition of rocket motors containing solid propellants. External sources of electrical charge buildup include natural lightning, electromagnetic pulses, high power microwave energy, and the like. In addition, static electricity charges are normally present at the interfaces between various phases in the propellant, insulation, liner and other parts of the rocket motor.

Sudden discharge of this electrostatic energy may generate sufficient heat to ignite the solid propellant, resulting in an explosion. This may occur during manufacturing, operation, storage, transportation, or deployment of materials used in the rocket motor or of the rocket motor. Such catastrophic events have the potential for causing harm to people and property.

Composite solid propellants have a very complex microstructure that includes a dense packing of particles embedded in a polymeric binder matrix. The particles typically include fuels, oxidizers, combustion control agents, and the like. These particles may have a wide variety of sizes, shapes and electrical properties. Electrostatic charges typically build up on the interfaces of binder and filler ingredients of the solid propellant, on the grain surface, and at the interfaces between other ingredients of the propellants, such as at the interfaces between the particles and a non-conductive or less-conductive binder.

Certain propellant compositions have a greater conductivity than other compositions. Propellants having a polar polymeric binder may contain dissociated ionic species that are available for charge transport and have relatively high conductivity. In compositions including this type of propellant binder system, electrostatic charges are readily dissipated, and catastrophic discharge is unlikely. For the propellant composition having conductive particles in a polybutadiene/acrylonitrile/acrylic acid terpolymer (PBAN) binder, the polar nitrile functional groups of the PBAN impart conductivity to the propellant composition. In addition, a quaternary benzyl alkyl ammonium chloride is added to the PBAN during manufacturing process. This results in enhanced electrical conductivity in the propellant, further reducing the possibility of premature ignition or explosion due to electrostatic discharge.

A binder system commonly used in solid rocket propellant compositions is hydroxy-terminated polybutadiene (HTPB). In contrast to the PBAN systems, HTPB is nonpolar and has a high electrical resistivity value. Therefore, HTPB-based propellants are more susceptible, under certain circumstances, to charge buildup and have the potential for catastrophic electrostatic discharge. Moreover, for rocket propellant compositions, the buildup of electrostatic charge on the propellant surfaces should be reduced without decreasing a voltage at which the propellants incur a voltage breakdown. When the voltage becomes high enough, a rapid passing of the charge through the solid propellant causes a breakdown of the voltage that often results in premature ignition or explosion of the propellant. This voltage level is known as the "breakdown voltage."

U.S. Pat. No. 3,765,334, issued on Oct. 16, 1973 to Rentz et al., discloses that the electrostatic discharge may be reduced by adding graphite to the energetic materials. It is, however, reported that at least 16% weight of graphite is used to achieve adequate conductivity, and that greater amounts of graphite adversely affect performance of the energetic materials.

U.S. Pat. No. 4,072,546, issued on Feb. 7, 1978 to Winger, discloses the use of graphite fibers in solid propellant and gas generant compositions. However, it is known in the art that even small amounts of graphite fibers markedly increase the viscosity of propellant compositions, resulting in detrimental effects on processability and propellant rheology.

U.S. Pat. No. 5,547,525, issued on Aug. 20, 1996 to Bennett et al., discloses the use of highly conductive carbon fibrils in energetic compositions for reducing electrostatic discharge susceptibility. The carbon fibrils are grown catalytically from carbon precursors to create ordered layers of graphitic carbon disposed substantially concentrically about a cylindrical axis of the fibrils. The carbon fibrils include an inner core region that may be hollow or may contain amorphous carbon. Although these carbon fibrils are present at a significantly lower amount, compared to the graphite and graphite fibers discussed above, the carbon fibrils still detrimentally impact the processability and rheology of the energetic compositions.

Carbon black is an amorphous carbon having a specific surface area from about 15 $m^2/g$ to about 1,650 $m^2/g$ as measured by a nitrogen adsorption BET technique according to the ASTM D 6556 method. Various grades of carbon black are commercially available with different carbon elemental content, specific surface area, particle size, pore size, etc. For instance, carbon black has a particle size of between about 1 μm and about 3 μm. Amorphous carbon does not possess an ordered layer structure, such as those of graphite, graphite fibers, or carbon fibrils having graphitic carbon disposed substantially concentrically about the cylindrical axis of the fibrils. Graphite has an ordered layer structure and, therefore, is known for its conductivity and ability to impart electrostatic charge dissipation in energetic compositions, such as solid propellant compositions.

U.S. Pat. No. 6,982,013, issued on Jan. 3, 2006 to Fallis et al., discloses an electrostatic charge dissipation composition that includes at least one energetic particle component, at least one non-conducting binder in combination with the energetic particle component, and at least one electrically active polymer coated on the energetic component/binder mixture. The electrically active polymer is oxidized after being coated onto the energetic component/binder mixture to provide sufficient conductivity that prevents premature electrostatic discharge of the composition. These electrostatic charge dissipation compositions are relatively more complicated and costly to produce; therefore, their uses may be limited to certain applications.

Accordingly, there is a need for precursor formulations suitable for use in energetic compositions that provide sufficient conductivity to reduce electrostatic discharge susceptibility, without affecting the energetic performance of the energetic compositions. The precursor formulations should be processible and provide the energetic composition with comparable ballistic, mechanical, and rheological properties as known energetic compositions. It would be further beneficial for such precursor formulations to be produced using existing production processes and equipment without significant increase in production cost and complexity.

Furthermore, it is desirable to have precursor formulations for a propellant composition having improved electrostatic charge dissipation to reduce the buildup of dangerous voltage levels on the propellant surface, without reducing the voltage at which the propellant incur a voltage breakdown.

BRIEF SUMMARY

A precursor formulation of an energetic composition having improved electrostatic charge dissipation is disclosed. The precursor formulation includes an amorphous carbon black having a specific surface area of at least about 1,200 $m^2/g$, in an amount from about 0.05% to about 0.25% weight.

Also disclosed is a precursor formulation of a propellant composition with improved electrostatic charge dissipation. The precursor formulation includes a binder, at least one of a fuel and an oxidizer, and amorphous carbon black having a specific surface area of at least about 1,200 $m^2/g$, the amorphous carbon black including from about 0.05% by weight to about 0.25% by weight of a total weight of the propellant composition.

Further disclosed is a rocket motor including a liner on an insulation of a rocket motor and a propellant on the liner. The propellant is produced from a precursor formulation comprising a binder, at least one of a fuel and an oxidizer, and amorphous carbon black having a specific surface area of at least about 1,200 $m^2/g$. The amorphous carbon black includes from about 0.05% by weight to about 0.25% by weight of a total weight of the propellant composition.

DETAILED DESCRIPTION

Figure 1:
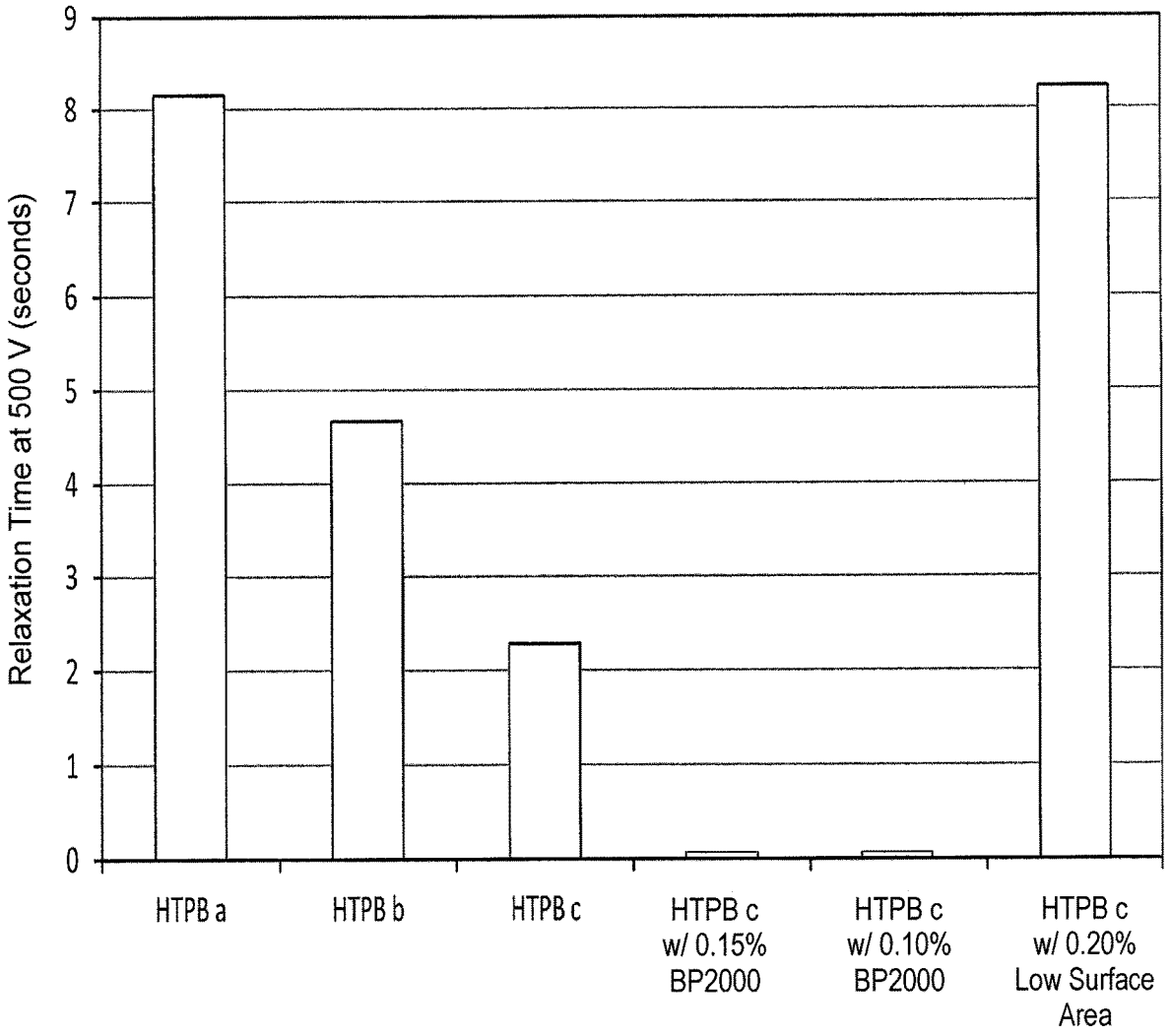
FIG. 1 is a graph showing relaxation times for different propellant compositions including propellant compositions according to embodiments of the present disclosure.

A precursor formulation of an energetic composition with improved electrostatic charge dissipation is disclosed and includes a high surface area carbon black. As used herein, the term "high surface area carbon black" means and includes an amorphous carbon black having a specific surface area of at least about 1,200 $m^2/g$ as measured by nitrogen adsorption BET technique according to the ASTM D 6556 method. The ASTM D 6556 method is well known in the art and, therefore, is not described in detail herein. The surface area of the high surface area carbon black is an as received measurement, before additional processing of the high surface area carbon black or energetic composition is conducted. As used herein, the term "energetic composition" may include, but is not limited to, a propellant, gas generant, or pyrotechnic composition. By including the high surface area carbon black, the energetic composition may be static dissipative. In addition, the addition of the high surface area carbon black may not affect the voltage at which the energetic composition incurs a voltage breakdown.

As used herein, the terms "comprising," "including," "containing," "characterized by," and grammatical equivalents thereof are inclusive or open-ended terms that do not exclude additional, unrecited elements or method acts. There terms also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure, and such term is used in preference to the more restrictive term "is" so as to avoid any implication that other, compatible materials, structures, features and methods usable in combination therewith should or must be excluded.

While other carbon forms (e.g., graphite, carbon fibrils) have previously been used in propellant formulations, it was surprising and unexpected that the high surface area carbon black functioned as an electrostatic charge dissipation agent in the energetic compositions. In the present disclosure, the energetic compositions including a small amount of the high surface area carbon black exhibited enhanced electrostatic charge dissipation performance without detrimental effects on processing and rheological properties. Without being bound by any theory, it is believed that the improved electrostatic charge dissipation properties is due to the less ordered structure of the high surface area carbon black compared to the ordered structure of graphite, graphite fibers, or carbon fibrils used previously. In addition, energetic compositions including lower surface area carbon black (i.e., amorphous carbon black having a surface area of less than about 140 $m^2/g$, also referred to herein as "low surface area carbon black"), surprisingly did not exhibit the desired electrostatic charge dissipation properties.

The precursor formulations of an energetic composition may include the high surface area carbon black in an amount from about 0.05% by weight (wt %) to about 0.25 wt % to provide the desirable enhanced electrostatic charge dissipation performance without detrimental effects on processing and rheological properties. Non-limiting examples of energetic compositions are solid propellants, gas generant compositions, and pyrotechnic compositions. In one embodiment, the precursor formulations may be suitable for use as a propellant having at least about 85% solids. In one embodiment, the precursor formulations may be suitable for use as a solid rocket propellant.

As discussed in the examples below and shown in TABLE 1 and FIG. 1, a propellant composition including an amorphous carbon black having a specific surface area of less than about 40 $m^2/g$ (i.e., "HTPB c w/0.20% Low Surface Area Carbon Black" of FIG. 1, also referred to herein as "low surface area carbon black") does not exhibit any decrease in the relaxation time and therefore does not exhibit any improvement in the electrostatic charge dissipation, compared to a control propellant composition of the same formulation but lacking carbon black (i.e., "HTPB a," "HTPB b" and "HTPB c"). On the other hand, a propellant composition including the high surface area carbon black (i.e., "HTPB c w/0.15% BP2000" and "HTPB c w/0.10%

BP2000") shows a significant decrease in the relaxation time and therefore a substantial improvement in the electrostatic charge dissipation, compared to the control propellant composition of the same formulation but lacking carbon black and to the propellant composition including the low surface area carbon black.

In the examples, BLACK PEARLS® 2000 carbon black from Cabot Corporation (Pampa, Tex.) is used as the high surface area carbon black. BLACK PEARLS® 2000 carbon black has been reported to have a specific surface area from about 1,200 $m^2/g$ to about 1,650 $m^2/g$. However, other carbon black materials having the desired surface area may also be used.

TABLE 1

| Propellant Composition | Propellant Type | Volume Resistivity (Ohm-cm @ V) | Dielectric Constant at 1 kHz | Relaxation Time at 500 V (sec) | Dielectric Breakdown Voltage at 0.25 inch (kV) |
|---|---|---|---|---|---|
| HTPB a | HTPB | $7.58 \times 10^{13}$ @500 | 7.2 | 8.15 | 6.3 |
| HTPB b | HTPB | $1.32 \times 10^{13}$ @500 | 7.7 | 4.67 | 12 |
| HTPB c | HTPB | $9.59 \times 10^{11}$ @500 | 7.9 | 2.29 | 6.3 |
| HTPB c w/0.15% BP2000 | HTPB | $1.97 \times 10^{8}$ @500 | 34.5 | 0.0006 | 8.7 |
| HTPB c w/0.10% BP2000 | HTPB | $1.79 \times 10^{9}$ @500 | 19.7 | 0.0031 | 6.7 |
| HTPB c w/0.20% Low Surface Area Carbon Black | HTPB | $1.29 \times 10^{13}$ @100 | 7.2 | 8.23 | 10 |

Figure 2:
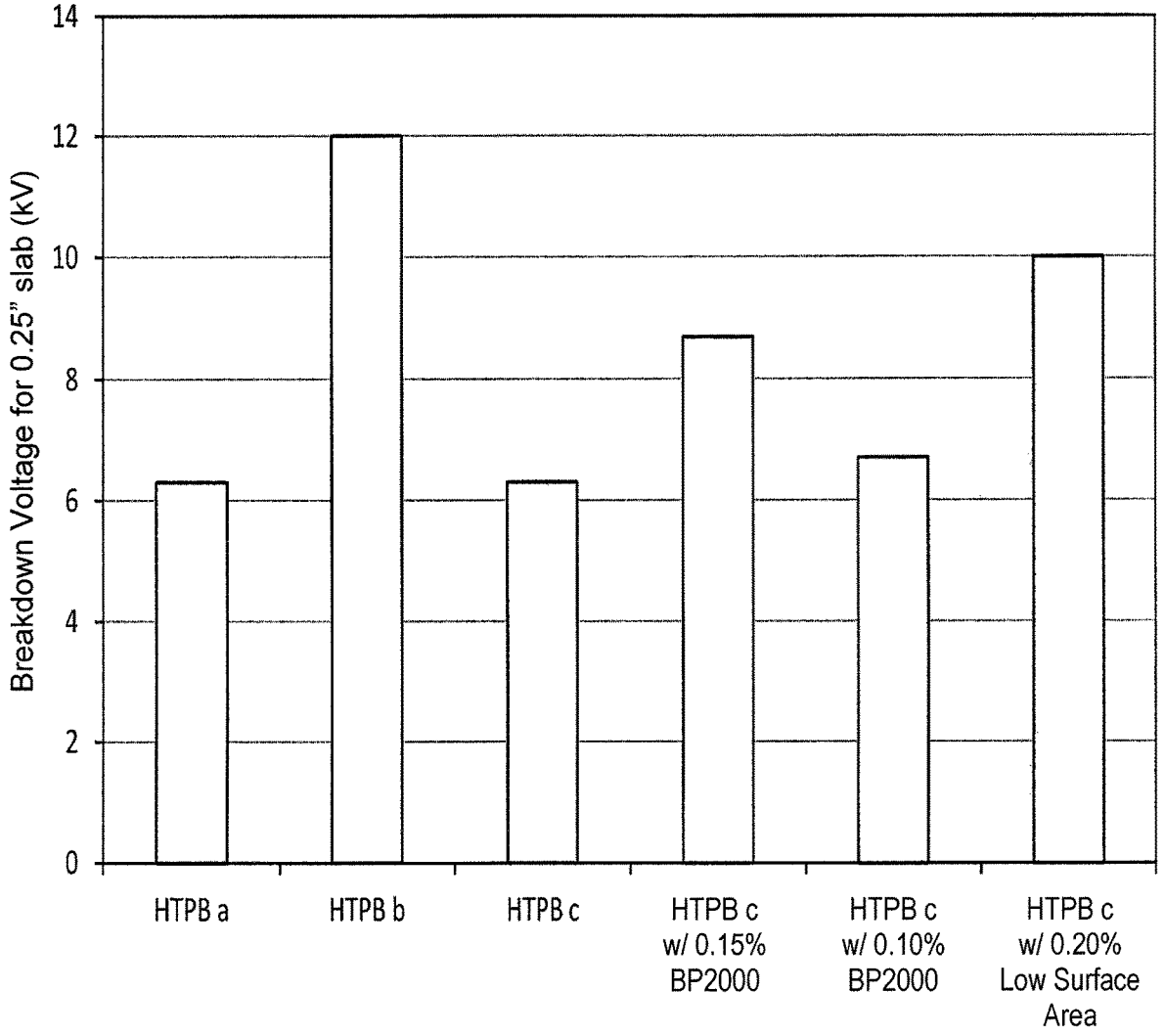
FIG. 2 is a graph showing breakdown voltages for different propellant compositions including propellant compositions according to embodiments of the present disclosure.

Furthermore, as shown in TABLE 1 and FIG. 2, a propellant composition including the high surface area carbon black (i.e., "HTPB c w/0.15% BP2000" and "HTPB c w/0.10% BP2000") exhibits comparable breakdown voltage as those for a control propellant composition of the same formulation but lacking carbon black (i.e., "HTPB a," "HTPB b" and "HTPB c") and that for the propellant composition including low surface area carbon black (i.e., "HTPB c w/0.20% Low Surface Area Carbon Black").

Therefore, the high surface area carbon black may impart enhanced electrostatic charge dissipation properties to the propellant compositions without affecting the breakdown voltage properties. In addition to providing the propellant compositions with effective static dissipation, the high surface area carbon black is less expensive than carbon fibrils and, therefore, may reduce the costs associated with producing the propellant compositions.

As described above, the precursor formulation of the energetic compositions may include the high surface area carbon black in an amount from about 0.05% to about 0.25% weight based on total weight. When the precursor formulation includes the high surface area carbon black in an amount of greater than 0.25% weight, the viscosity of the precursor formulation may increase, affecting processability of the formulation. In addition, the precursor formulation may have poor rheological properties and short pot life for any practical uses, or both. In some embodiments, the precursor formulation may include the high surface area carbon black in an amount from about 0.075 wt % to about 0.15 wt % based on the total weight of the energetic composition. In other embodiments, the precursor formulation may include the high surface area carbon black in an amount of from about 0.05 wt % to less than about 0.10 wt % based on the total weight of the energetic composition.

It is understood that the amount of the high surface area carbon black in the disclosed precursor formulation may be adjusted based on several factors including, but not limited to, the type of energetic composition to be produced, the polarity/conductivity of other ingredients in the energetic composition, the processing conditions, the desired static dissipative properties and the desired rheological properties of the energetic composition.

The precursor formulation of the energetic composition also includes other ingredients, such as at least one of a binder, a fuel, and an oxidizer. The binder may be an energetic or non-energetic polymer as described in more detail below. The fuel may be a metal, such as aluminum, zirconium, magnesium, boron, or combinations thereof. The oxidizer may include ammonium perchlorate (AP), ammonium dinitramide (ADN), ammonium nitrate, or combinations thereof. The precursor formulation of the energetic composition may also include a nitramine, such as cyclotetramethylene tetranitramine (HMX), cyclotrimethylene trinitramine (RDX), 2,4,6,8,10,12-hexanitro-2,4,6,8,10,12-hexaazatetracyclo [5.5.0$^5$,9.0$^3$,11]-dodecane or 2,4,6,8,10,12-hexanitrohexaazaisowurtzitane (CL-20), or combinations thereof. Depending on the desired properties, the precursor formulation of an energetic composition may optionally include plasticizers, curing agents, cure catalysts, ballistic catalysts, and other additives, which are known in the art and, therefore, are not described in detail herein.

The precursor composition according to embodiments of the present disclosure may be produced by combining the high surface area carbon black with the other ingredients. The high surface area carbon black may be combined with other ingredients by conventional techniques, such as by simple mixing or high shear mixing, which are not described in detail herein. The high surface area carbon black may be dispersed throughout the energetic composition, such as in the binder. The energetic composition may have a viscosity within a range of from about 2 kp to about 40 kp at a temperature between about 120° F. and 135° F.

In one embodiment, a precursor formulation of a propellant composition may include a binder; at least one of a fuel and an oxidizer; and amorphous carbon black having a specific surface area of at least about 1,200 $m^2/g$ as measured by nitrogen adsorption BET technique according to the ASTM D 6556 method, the amorphous carbon black including from about 0.05% by weight to about 0.25% by weight of a total weight of the propellant composition.

The amount of the high surface area carbon black in the precursor formulation of the propellant composition may be adjusted based on several factors including, but not limited to, the polarity/conductivity of other ingredients in the propellant composition, the solids content of the propellant composition, the selected volume resistivity, the processing conditions, and the desired rheological properties.

Even small amounts of the high surface area carbon black may increase viscosity and lower pot life of the propellant composition with high solids (e.g., propellants with more than 85% solids). Low solids propellant compositions (e.g., propellants having less than about 70% solids) may include a greater amount of the high surface area carbon black before the viscosity of the propellant composition exceeds practical processing levels. In one embodiment, the disclosed propellant compositions may have a solid content of at least about 85% solids.

The disclosed propellant composition may further include other ingredients known in the art. Non-limiting examples of other ingredients may be a bonding agent, a plasticizer, a catalyst, a crosslinking agent, an oxidizing agent, and a propellant additive.

In one embodiment, the amount of high surface area carbon black in the propellant composition may be sufficient to decrease the volume resistivity of the composition to a level below or on the order of about $1\times10^{10}$ ohm-cm. The amount of high surface area carbon black utilized to achieve the desired volume resistivity reduction may depend on other ingredients of the propellant composition. For example, propellant compositions containing a polar binder, polar plasticizer, or various ionizable salts have higher electrostatic charge dissipation than propellant compositions containing nonpolar ingredients. Therefore, a propellant composition having polar ingredients may utilize a lower amount of the high surface area carbon black to achieve the desired electrostatic charge dissipation, compared to propellant compositions containing nonpolar ingredients. Furthermore, equal quantities of the high surface area carbon black may exhibit a greater change in electrostatic charge dissipation in the nonpolar system than in the polar system.

Various known binders for propellant compositions may be used. Non-limiting examples of such binders are hydroxyl terminated polybutadiene (HTPB), carboxyl terminated polybutadiene (CTPB), polybutadiene/acrylonitrile/acrylic acid terpolymer (PBAN), polybutadiene-acrylic acid polymer (PBAA), nitrate ester polyether (NEPE), and glycidyl azide polymer (GAP). In some embodiments, the binder may be a nonpolar polymeric binder such, for example, as HTPB.

Figure 3:
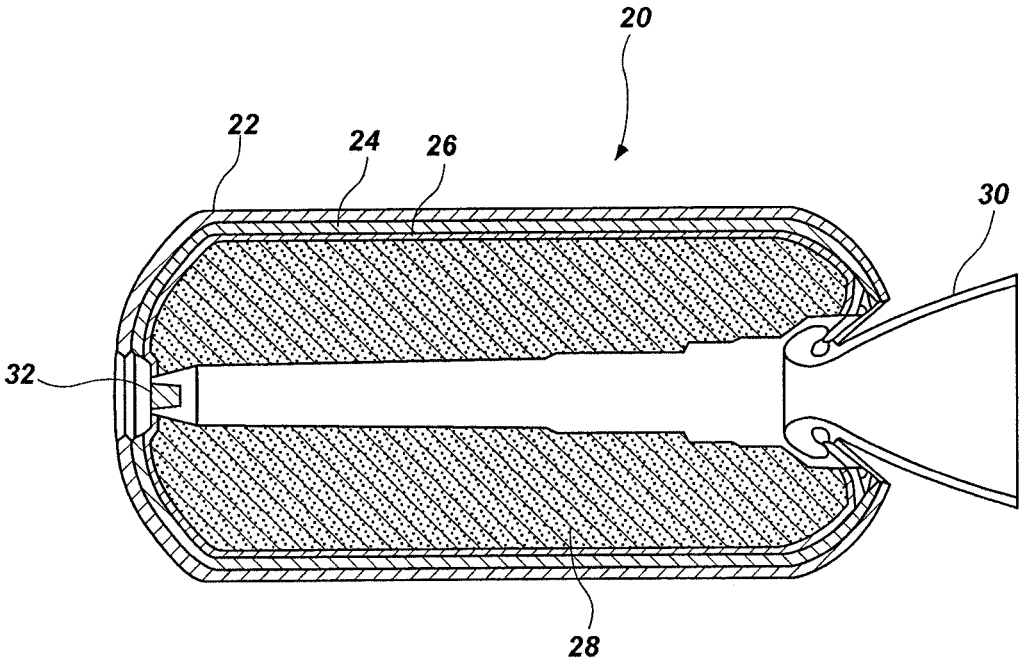
FIG. 3 is a simplified cross-section of a rocket motor including a propellant formed from a precursor formulation according to an embodiment of the present disclosure.

The precursor formulation of the energetic composition may be used in a rocket motor 20, which may include casing 22, insulation 24, liner 26, and propellant 28 as shown in FIG. 3. The propellant 28 may be formed from an embodiment of the precursor formation having the high surface area carbon black, as previously described. The rocket motor 20 may also include a nozzle assembly 30, an igniter 32, and other conventional components, which are not illustrated for simplicity and convenience. The insulation 24, liner 26, and propellant 28 may be formed and applied to the casing 22 by conventional techniques, which are not described in detail herein.

The following examples serve to explain embodiments of the present more detail. These examples are not to be construed as being exhaustive or exclusive as to the scope of this disclosure.

EXAMPLES

Various propellant compositions were prepared as shown in TABLE 1 at about the same solids content of 88% solids. Hydroxyl terminated polybutadiene (HTPB) was used as a binder. Other ingredients in the solid propellant compositions included a bonding agent, a plasticizer, a burn rate catalyst, a crosslinking agent, an oxidizer, and a fuel such as aluminum powder.

The carbon black BLACK PEARLS® 2000 from Cabot Corporation (Pampa, Tex.) was used as the high surface area carbon black. Carbon black N991 from supplier Cancarb Ltd. (Alberta, Canada) was used as a low surface area carbon black for comparative purposes. The low surface area carbon black had a specific surface area of about 30 $m^2/g$.

The propellants were tested for volume resistivity, dielectric constant at 1 kHz, relaxation time at 500 volts, and dielectric breakdown voltage for a 0.25 inch-slab. These test procedures are well known in the art, and therefore not described herein.

FIG. 1 is a graph showing relaxation times for the different propellant compositions. As shown in FIG. 1 and TABLE 1, the HTPB-based propellant composition without the high surface area carbon black exhibited an electrical relaxation time of about 8.23 seconds, depending on the formulation, when a high voltage of 500 volts was applied. The control HTPB-based propellant compositions lacking carbon black (:HTPB a," "HTPB b" and "HTPB c") exhibited electrical relaxation times of 8.15 seconds, 4.67 seconds, and 2.29 seconds, respectively. However, in the propellant compositions including about 0.15 wt % ("HTPB c w/0.15% BP2000") and about 0.10 wt % ("HTPB c w/0.10% BP2000") of the high surface area carbon black, the relaxation times dropped to less than one second (0.0006 second for the propellant composition including 0.15 wt % of the high surface area carbon black, and 0.0031 second for the propellant composition including 0.10 wt % of the high surface area carbon black). This decrease in the relaxation time significantly reduces the likelihood of dangerous voltage levels accumulating on the propellant surface. The HTPB-based propellant composition including low surface area carbon black ("HTPB c w/0.20% Low Surface Area Carbon Black") showed about the same relaxation time as those of the control HTPB-based propellant compositions.

FIG. 2 is a graph showing dielectric breakdown voltages for the different propellant compositions. As shown in FIG. 2 and TABLE 1, the HTPB-based propellant compositions including the high surface area carbon black ("HTPB c w/0.15% BP2000" and "HTPB c w/0.10% BP2000") showed similar breakdown voltages as those for HTPB-based propellant compositions lacking carbon black ("HTPB a," "HTPB b" and "HTPB c").

The propellant compositions including the high surface area carbon black bled off charge very quickly from high voltage levels (approximately 500 volts) to much lower, desired voltage levels. Thus, it was determined that the low amounts of high surface area carbon black present in the propellant compositions was effective to make the propellant compositions dissipate static electricity. In addition, the high surface area carbon black imparted a significantly increased electrostatic charge dissipation to the propellant composition, without affecting the breakdown voltage of the propellant composition.

While the disclosure may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the scope of the following appended claims and their legal equivalents.

What is claimed is:

1. A precursor formulation of a propellant composition, consisting of:

aluminum, ammonium perchlorate, and a binder consisting of a hydroxyl terminated polybutadiene (HTPB);

at least one of a bonding agent, a plasticizer, or a cross-linking agent; and a conductive, amorphous carbon black having a specific surface area of at least about 1,200 $m^2/g$, the conductive, amorphous carbon black comprising from about 0.05% by weight to about 0.25% by weight of a total weight of the propellant composition.

* * * * *